United States Patent [19]

Sallee et al.

[11] 4,007,024

[45] Feb. 8, 1977

[54] PORTABLE ELECTROSTATIC AIR CLEANER

[75] Inventors: John P. Sallee; Bill W. Speight; Bruce H. McLain, all of Nashville, Tenn.

[73] Assignee: Air Control Industries, Inc., Nashville, Tenn.

[22] Filed: June 9, 1975

[21] Appl. No.: 584,958

[52] U.S. Cl. ..... 55/126; 55/131; 55/138; 55/139; 55/140; 55/147; 55/151; 55/154

[51] Int. Cl.[2] ..... B03C 3/01

[58] Field of Search ..... 55/6, 128–130, 55/131, 138, 139, 126, 140, 141, 143, 145, 146–148, 150, 151, 153, 154

[56] References Cited

UNITED STATES PATENTS

| | | | |
|---|---|---|---|
| 2,933,151 | 4/1960 | Kurtz | 55/145 |
| 3,108,865 | 10/1963 | Berly | 55/131 |
| 3,469,031 | 9/1969 | Setchell | 55/139 |
| 3,763,633 | 10/1973 | Soltis | 55/139 |
| 3,800,509 | 4/1974 | Carr et al. | 55/131 |

FOREIGN PATENTS OR APPLICATIONS

| | | | |
|---|---|---|---|
| 352,901 | 5/1922 | Germany | 55/130 |

OTHER PUBLICATIONS

Electronic Air Cleaner SL–10–Detc–Electro–Air Div. Emerson Electric Ltd. 11/69 pp. 1–4 Manual S700–D.

*Primary Examiner*—Bernard Nozick
*Attorney, Agent, or Firm*—Harrington A. Lackey

[57] ABSTRACT

A portable electrostatic air cleaning device having a minimal depthwise air-flow dimension, and particularly adapted to be substituted in an air conduit for a typical furnace or air conditioner filter. Ionizer wires and narrow collector plates are alternately spaced widthwise of the air cleaner, preferably between a pre-filter screen and an after-filter screen. The narrow collector plates are mounted within the device at an angle to the air flow direction to effectively lengthen the air flow through the air cleaning device.

The pre-filter screen and the after-filter screen preferably contain electrically conductive materials which are charged to the same potential as the collector plates in order to maximize the electrostatic field strengths.

5 Claims, 6 Drawing Figures

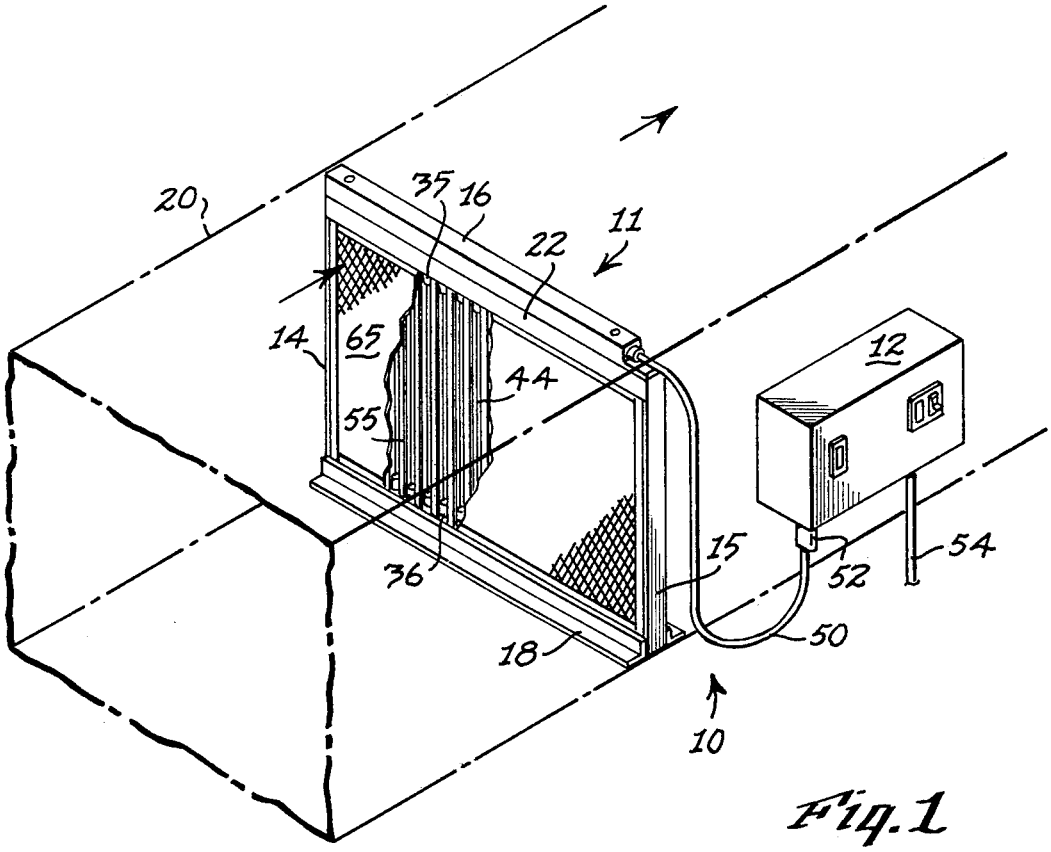
Fig. 1
Fig. 4
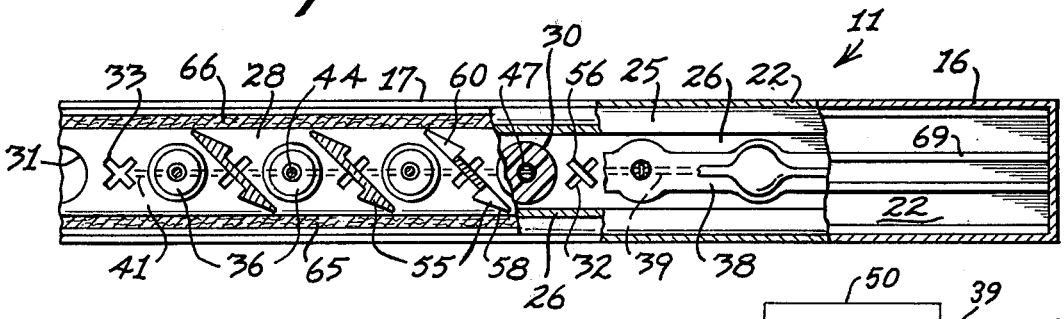
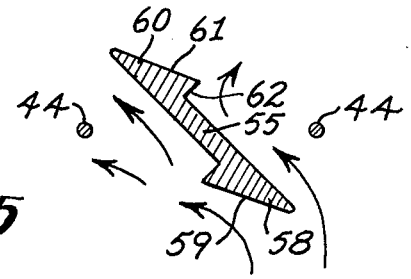
Fig. 5
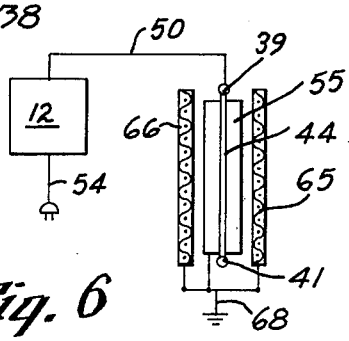
Fig. 6

PORTABLE ELECTROSTATIC AIR CLEANER

BACKGROUND OF THE INVENTION

This invention relates to an electrostatic cleaning device, and more particularly to a portable electrostatic air cleaning device having a minimal depthwise air-flow dimension.

Electrostatic precipitators of air cleaning devices are well-known in the art. Such devices usually include two stages for treating the air, a first ionizing stage and a second collector stage. In the ionizing stage, the air moves past one or more ionizing wires from which are spaced ground electrodes to provide an electrostatic field in which the particles in the air are ionized or electrically charged. The ionized particles then move through the second collector stage, which constitutes a plurality of alternately charged and grounded parallel collector plates creating electric fields. The ionized particles are attracted to one collector plate or the other, depending upon the charge on the particle. The air then leaves the second stage, minus the particles, in a cleaner and more purified state.

Most electrostatic precipitators are provided with power packs, most of which include a voltage doubling circuit for applying a voltage to the ionized wires approximately twice as great as the voltage applied to the collector plates.

Examples of the above types of electrostatic precipitators are disclosed in prior U.S. Pat. Nos. 1,343,285 of Schmidt; 1,992,974 of Thompson; 2,813,595 of Fields; 2,925,881 of Berly et al; and 3,665,679 of McLain et al.

In conventional heating and air conditioning ducts, an ordinary type of air filter, such as a screen having small pores or openings to mechanically classify or separate large particles from the air stream, is removably supported in tracks transversely within the air duct normal to the air flow. The depthwise dimension or air-flow dimension of such mechanical filters is small and usually about one inch.

Although electrostatic precipitators of the type above described, including two stages of separation, may be mounted within conventional air ducts, nevertheless considerable alteration of the existing ducts must be made in order to properly mount such precipitators within the duct. The two-stage electrostatic precipitators are not only bulky, but have a substantial depthwise dimension. Thus, the existing two-stage electrostatic precipitators are not adapted to be substituted for conventional mechanical heating or air conditioning filters.

SUMMARY OF THE INVENTION

It is therefore an object of this invention to provide a portable electrostatic air cleaning device including a frame having a minimal depthwise or air-flow dimension, and yet which will be effective in electrostatically precipitating and collecting very small solid particles, as small as 0.1 micron, and including such particles as lint, pollen, mold spores, coal dust, soot, animal dander, insecticides, bacteria, dust, fumes and tobacco smoke.

Furthermore, it is an object of this invention to provide a portable air cleaning device which is capable of being substituted for a conventional mechanical filter screen within an existing heating or air conditioning duct.

The air cleaning device made in accordance with this invention includes a frame having a depthwise or air-flow dimension quite small compared with its longitudinal or widthwise dimensions, and preferably equal to the width of existing filter screen tracks in a conventional air duct to permit substitution of the air cleaning device frame for the conventional filter screen, by merely sliding out the filter screen and sliding in the air cleaner frame.

The electrostatic air cleaning device made in accordance with this invention includes a plurality of ionizer wires or electrodes mounted or suspended longitudinally of the frame of the air cleaning device and preferably uniformly spaced widthwise of the frame. Mounted between each pair of electrodes is a narrow collector plate set at an angle to the depthwise dimension to provide angular, and therefore longer air flow between the collector plates from the upstream opening to the downstream opening of the air cleaner frame.

The electrostatic cleaning device made in accordance with this invention preferably includes a pre-filter screen of conductive material and an after-filter screen of conductive material, such as expanded metal aluminum. The conductive material within the pre-filter and after-filter screens is charged with the same potential as the collector plates to strengthen the electrostatic field around each charged ionizer wire.

Each collector plate is also provided with thickened vanes at the longitudinal edges thereof which project in opposite directions, not only to stiffen the elongated collector plates, but also to further divert and slow down the air stream passing between the plates in order to maximize the precipitation of particles electrostatically during the passage of the solid-laden air through the air cleaning device.

BRIEF DESCRIPTION OF THE DRAWINGS

FIG. 1 is a top front perspective view, with portions broken away, of the air cleaning device made in accordance with this invention, installed in an air duct, disclosed in phantom;

FIG. 4 is a section taken along the line 4—4 of FIG. 2; and

FIG. 5 is an enlarged, transverse section through a collector plate and a pair of ionizer wires.

FIG. 6 is an electric circuit of electrostatic air cleaner.

DESCRIPTION OF THE PREFERRED EMBODIMENT

Figure 2:
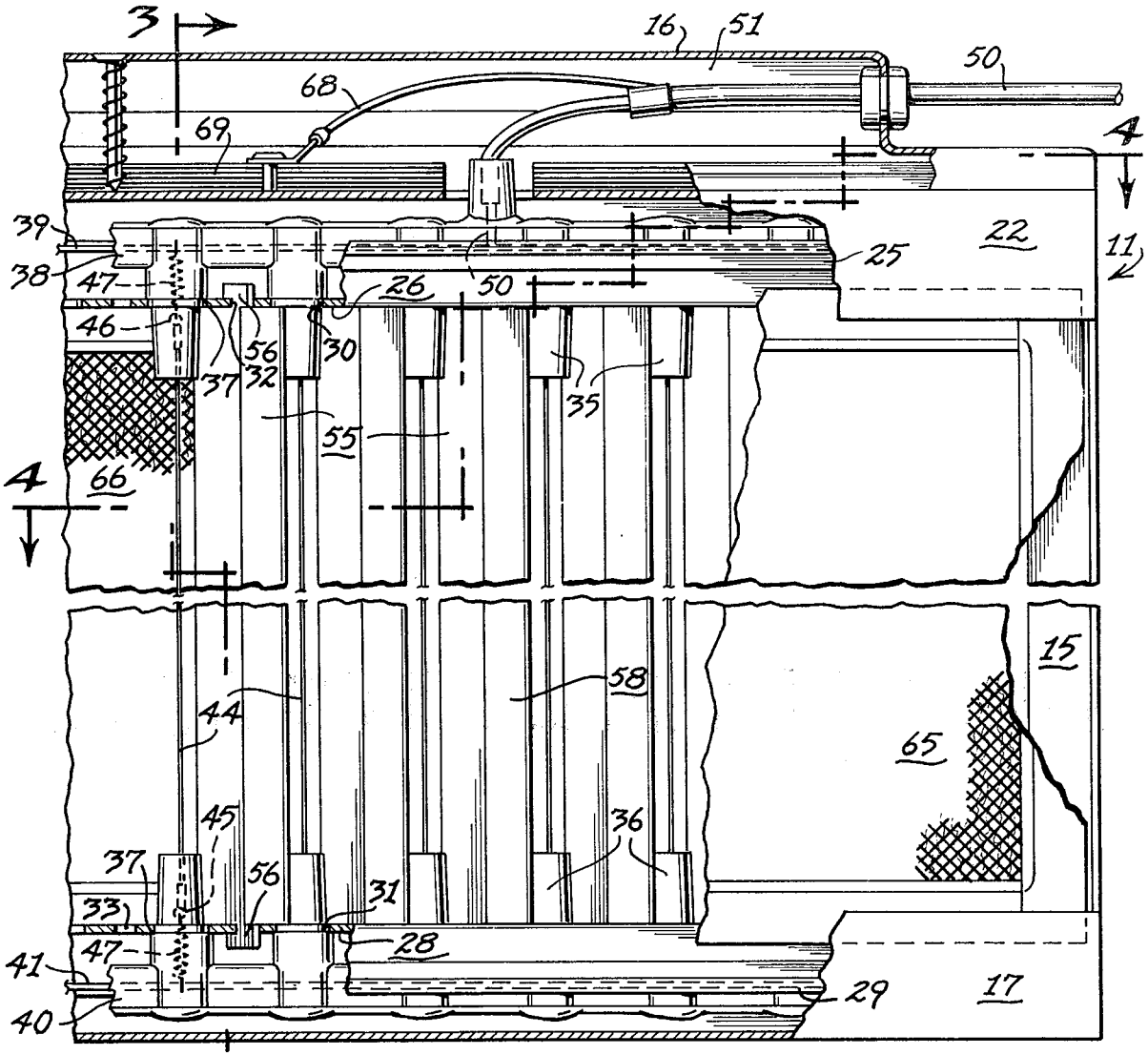
FIG. 2 is an enlarged, fragmentary, front sectional elevation of the air cleaning cell, with portions broken away and partly in section.
Figure 3:
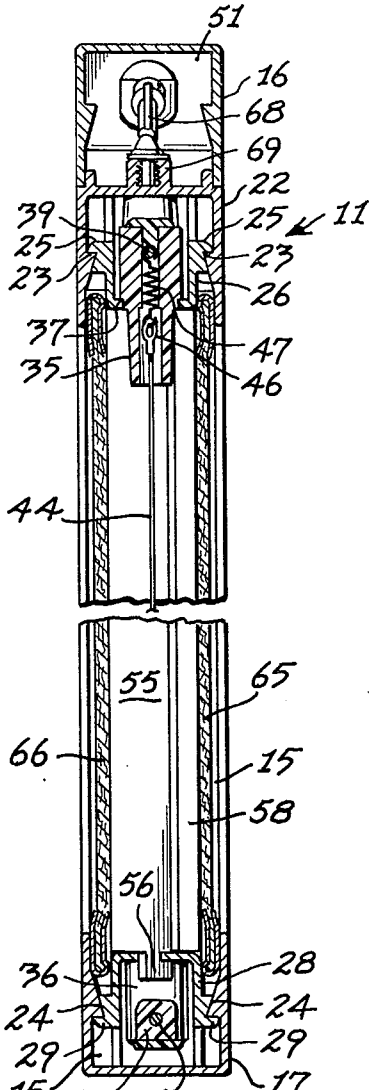
FIG. 3 is a section taken along the line 3—3 of FIG. 2.

Referring now to the drawings in more detail, FIG. 1 discloses an electrostatic air cleaning device 10 made in accordance with this invention including an air cleaner unit or cell 11 and a power pack 12.

The air cleaner cell 11 comprises a rectangular frame including a pair of side frame members 14 and 15 elongated in the height or longitudinal dimension and a top frame member 16 and bottom frame member 17 elongated in the widthwise dimension. The frame members 14, 15, 16 and 17 are disposed in the same plane and have a uniform depthwise dimension in the air-flow direction of substantially less value than the longitudinal and widthwise dimensions of the cell 11.

As disclosed in FIG. 1, the depthwise dimension of the cell 11 is about 1 inch, and more specifically about 15/16th of an inch, so that the bottom frame member 17 and the top frame member 16 form parallel runners adapted to be slidably received within tracks, such as the bottom track 18 of the air conditioning conduit 20.

Supported beneath the top frame member 16 is a top frame mounting housing 22. The top frame mounting housing 22 is an essentially inverted channel having inwardly projecting ledges 23. The bottom frame member 17 may be of a shape identical to the top frame mounting housing 22, but being turned upside down in relation to the mounting housing 22 and having inward projecting bottom ledges 24. As a matter of fact, the top frame mounting housing 22 and the bottom frame member may be cut from the same extruded channel.

Supported upon the ledges 23 of the mounting housing 22 by ears 25 is a channel-shaped upper mounting plate 26. A lower mounting plate 28 may be of identical cross-section and made from the same extruded channel member as the upper mounting plate 26, but turned upside down so that its ears 29 may seat against the ledges 24.

As best disclosed in FIG. 4, each of the upper and lower mounting plates 26 and 28 is punched with a series of uniformly spaced holes 30 and 31, respectively. Uniformly spaced between the holes are punched a plurality of cross-slots 32 and 33, respectively.

Fitted within each of the holes 30 and 31, which are longitudinally aligned, are a plurality of tubular insulator sockets 35 and 36, respectively. The upper sockets 35 open downward, while the lower sockets 36 open upward in alignment with their corresponding upper sockets. Each of the upper sockets 35 and lower sockets 36 are provided with enlarged shoulders 37 to bear against the respective surfaces of the upper and lower mounting plates and to prevent the sockets from being pulled through the respective holes 30 and 31.

The upper end portions of the upper sockets 35 are connected by an elongated insulator jacket 38 surrounding an elongated upper bus conductor 39. In a similar manner, the lower sockets 36 are connected by an insulator jacket 40 encasing an elongated common bus conductor 41.

Electrically connecting the bus conductors 39 and 41 are a plurality of ionizer wires or electrodes 44. The lower ends of the ionizer wires 44 extend through the tubular sockets 36 and terminate in conductor loops 45 in electrical contact with the lower bus conductor 41 through a tension spring 47. The upper end of each ionizer wire 44 terminates in a loop 46 which is also connected to the upper bus conductor 39 through upper conductive coil spring 47. One end of each spring 47 is hooked around the corresponding bus conductor 39 and 41, while the other end is hooked to the corresponding loop 45 and 46. In this manner, each ionizer wire 44 is maintained in tension stretched between the bus conductors 39 and 41. If desired, the loop 45 may be connected directly to the bus conductor 41 and eliminate the lower tension spring 47.

The upper bus conductor 39 is connected to an insulated ionizer power lead 50, which extends through the upper chamber 51 defined by the inverted, channel-shaped, top frame member 16. The ionizing power supply lead 50 continues outside of the upper frame member 16 where it is connected by plug 52 into the power pack 12. The power pack 12 may be a conventional power pack unit which develops the necessary ionizing voltage, in this instance about 6,200 v. D.C., and which is provided with power through the power supply cord 54.

Mounted in uniform spaced relationship between each of the ionizer wires 44 are a plurality of elongated narrow collector plates 55. Each of the collector plates has a tab 56 on its end for projecting through one of the slots in the cross-slots 32 and 33. Each tab 56 may be swaged or welded, or otherwise secured to its respective mounting plates 26 and 28.

The cross-slots 32 are for manufacturing purposes, so that the identical mounting plates 26 and 28 may be formed from the same extruded channel, but opposing each other in inverted relationship, the cross-arms of the slots 32 will function to receive the tabs 56.

As disclosed in the drawings, the slots 32 are disposed at right angles to each other, and each slot is cut at a 45° angle to the depthwise dimension or the direction of air flow through the cell 11. Thus, each of the collector plates 55 is mounted at equal angles of 45° to the depthwise dimension of the cell 11.

As disclosed, particularly in FIG. 5, both the upstream and downstream surfaces of each collector plate 55 are substantially parallel to each other, except at the upstream and downstream extremities of each collector plate. The upstream extremity of each collector plate 55 forms a stiffener vane 58 having an outer surface 59 diverging from the upstream edge and the upstream surface of the collector plate 55, so as to direct air flow at a greater angle to the air-flow direction and generally toward the ionizer wire 44 on the upstream side of that particular collector plate 55.

On the downstream extremity of each collector plate 55 is a similarly shaped stiffener vane 60 diverging from the downstream edge or extremity of the collector plate 55 away from the downstream surface of the collector plate 55 and generally toward the ionizer wire 44 on the downstream side of the collector plate 55. The downstream stiffener vane 60 has a diverging surface 61, which meets a sharp, abruptly projecting surface 62, which causes air passing along the downstream surface of that particular collector plate 55 to be diverted toward the right, thereby slowing down the air passing between the collector plates 55 and to provide better opportunity for solid particles carried by the air stream to be mechanically retarded and electrically charged and drawn to the collector plates 55.

Another primary function of the vanes 58 and 60 is to increase the thickness of the end portions of the collector plate 55 and thereby stiffen the collector plate through its length.

The collector plates 55 are made of electrically conductive material so that they function as the negative or ground electrode for the electrostatic field created between the ionizer wires 44 and the collector plates 55.

The purpose of mounting the collector plates 55 at a substantial angle to the depthwise dimension of the cell 11 is to provide a longer path for the air flow through the cell 11, and yet to maintain a minimum depthwise dimension. Thus, the widths of the collector plates 55 can be greater than if they were mounted within the same depthwise dimension parallel to the air flow, thereby affording more negative electrode surface for the establishment of the electrostatic fields with the ionizer wires 44.

A pre-filter screen 65, preferably made of conductive material, such as expanded aluminum metal of rectangular shape and very thin dimensions is supported on the upstream end or side of the cell 11. As disclosed in the drawings, the thin flat edges of the pre-filter screen 65 are slip-fit between the corresponding walls of the channel-shaped bottom frame member 17, side frame members 14 and 15 and the upper mounting plate 22. The pre-filter screen 65 may be further secured by screws extending through the periphery of the screen and the channel walls of the frame members, if desired.

In a similar manner, an after-filter screen 66 may be identical in construction to the pre-filter screen 65 and mounted on the downstream end or side of the cell 11 in the same manner as the pre-filter screen 65 is mounted. The after-filter screen 66 is also made of conductive material, such as expanded aluminum metal.

The purpose of making the pre-filter screen 65 and the after-filter screen 66 of conductive material is to provide a substantially closed or continuous conductive area or wall of equal potential with the collector plates 55 surrounding each ionizer wire 44. As disclosed in FIG. 2, a ground cable 68 is connected to a portion of the frame 69. The frame portion 69 is in electrical conductive communication with all portions of the frame including the upper and lower mounting plates 26 and 28, the side frame members 14 and 15, the bottom frame member 18, the upper frame member 16 and the top frame mounting housing 22. The ground cable 68 is coupled to a ground lead, not shown, carried by the insulation of the ionizing supply cable 50. In this manner all of the collector plates 55 as well as the pre-filter screen 65 and the after-filter screen 66 are permanently connected to ground potential. On the other hand, the ionizer wires 44 are charged with approximately 6,200 positive volts D.C. In this manner, a very strong electrostatic field is formed around each ionizer wire 44 which will be encountered by the divided air streams angularly inverted through the air cleaner cell 11 by the angular collector plates 55.

What is claimed is:

1. A portable electrostatic air cleaning device comprising:

a. a frame having longitudinal, widthwise, and depthwise dimensions, an upstream end and a downstream end spaced depthwise from each other, said depthwise dimension being substantially less than said other dimensions so that said frame may be mounted in an air conduit transversely of the air flow, b. a plurality of elongated ionizer wire electrodes, c. means mounting said ionizer wire electrodes longitudinally within said frame and spaced apart in a plane widthwise of said frame between said upstream and downstream ends, d. a plurality of narrow, elongated collector plates, e. plate mounting means supporting said collector plates longitudinally within said frame between said upstream and downstream ends, each of said plates being spaced widthwise of said frame and intercepting the plane of said ionizer wire electrodes, f. each of said ionizer wire electrodes being spaced substantially midway between a pair of said collector plates, g. said plate mounting means supporting said collector plates substantially parallel to each other and at acute angles to said depthwise dimension, to lengthen the air flow paths through said frame from said upstream end to said downstream end, h. a pre-filter screen mounted in said upstream end of said frame substantially normal to said depthwise dimension, said pre-filter screen being made at least partially from electrical conductive material, i. an after-filter screen mounted in said downstream end of said frame and substantially normal to said depthwise dimension, said after-filter screen being made at least partially from electrical conductive material, j. means for applying an electrical charge of one potential upon said ionizer electrodes and another electrical charge of a substantially different potential upon said collector plates and the electrical conductive material of said pre-filter screen and said after-filter screen, to establish a strong electrostatic field around each of said ionizer wire electrodes.

2. The invention according to claim 1 in which the longitudinal extremities of said frame comprise parallel widthwise extending runners adapted to slide within cooperating tracks transversely of an air conduit, to dispose said frame normal to the air flow through said conduit.

3. The invention according to claim 1 in which each of said collector plates has opposite, substantially parallel, upstream and downstream planar surfaces and a substantially uniform thickness, a downstream stiffener vane having a surface projecting abruptly away from the downstream surface of said collector plate to direct air flow away from said abrupt surface toward an ionizer wire electrode on the downstream side of said collector plate.

4. The invention according to claim 1 in which each of said collector plates has opposite, substantially parallel, upstream and downsteam planar surfaces and a substantially uniform thickness, an upstream stiffener vane having a planar surface diverging from the upstream edge away from the upstream surface of said collector plate toward an ionizer wire electrode on the upstream side of said collector plate.

5. The invention according to claim 4 further comprising a downstream stiffener vane having a surface projecting abruptly away from the downstream surface of said collector plate to direct air flow away from said abrupt surface toward an ionizer wire electrode on the downstream side of said collector plate.

* * * * *